US010145551B2

(12) United States Patent
Brown et al.

(10) Patent No.: US 10,145,551 B2
(45) Date of Patent: Dec. 4, 2018

(54) LED LAMP WITH ACTIVE CHAMBER COOLING

(71) Applicants: Brian Brown, Simi Valley, CA (US); Brian Hennessy, Simi Valley, CA (US); Kevin Sanders, Simi Valley, CA (US)

(72) Inventors: Brian Brown, Simi Valley, CA (US); Brian Hennessy, Simi Valley, CA (US); Kevin Sanders, Simi Valley, CA (US)

(73) Assignee: TITAN LED, INC., Simi Valley, CA (US)

( * ) Notice: Subject to any disclaimer, the term of this patent is extended or adjusted under 35 U.S.C. 154(b) by 455 days.

(21) Appl. No.: 15/099,463

(22) Filed: Apr. 14, 2016

(65) Prior Publication Data

US 2016/0305640 A1 Oct. 20, 2016

Related U.S. Application Data

(60) Provisional application No. 62/148,016, filed on Apr. 15, 2015.

(51) Int. Cl.

| | |
|---|---|
| ***F21S 45/40*** | (2018.01) |
| ***F21V 29/00*** | (2015.01) |
| ***F21V 29/67*** | (2015.01) |
| ***F21V 29/74*** | (2015.01) |
| ***F21V 23/00*** | (2015.01) |
| ***F21V 5/04*** | (2006.01) |
| *F21W 131/40* | (2006.01) |
| *F21W 131/103* | (2006.01) |

(52) U.S. Cl.

CPC ..... *F21V 29/673* (2015.01); *F21V 5/04* (2013.01); *F21V 23/003* (2013.01); *F21V 29/74* (2015.01); *F21W 2131/103* (2013.01); *F21W 2131/40* (2013.01)

(58) Field of Classification Search

CPC ..... F21V 29/70; F21V 29/83; F21V 29/74; F21V 23/009; F21V 29/20; F21V 29/777; F21V 29/673; F21V 29/677; F21V 33/0096; F21S 45/47; F21S 45/49

USPC ..... 362/373

See application file for complete search history.

(56) References Cited

U.S. PATENT DOCUMENTS

2016/0169498 A1* 6/2016 Lei ..... F21V 29/677 362/234

FOREIGN PATENT DOCUMENTS

WO WO-2015024844 A1 * 2/2015 ..... F21V 29/677

* cited by examiner

*Primary Examiner* — William J Carter

(74) *Attorney, Agent, or Firm* — Cislo & Thomas, LLP

(57) ABSTRACT

An LED lamp employing active cooling chambers is presented. The lamp features a housing having two active cooling chambers. One chamber, i.e. the first or cold chamber, contains an LED driver and one or more cooling fans, while the second chamber, i.e. the hot chamber, contains one or more LED modules secured to a heat sink. Fluid (air) communication between the two chambers is controlled by the one or more cooling fans. In operation, the fans draw ambient cooling air inside the cold chamber via air intake openings in the housing. The cooling air is then forced through a plurality of heat sink fins and heat transfer channels and exhausted from air exhaust openings in the housing.

20 Claims, 16 Drawing Sheets

LED LAMP WITH ACTIVE CHAMBER COOLING

CROSS-REFERENCE TO RELATED APPLICATIONS

This patent application claims priority from U.S. Utility Application Ser. No. 62/148,016 entitled "LED Lamp with Active Chamber Cooling," filed on Apr. 15, 2015, which is incorporated herein by this reference.

BACKGROUND OF THE INVENTION

Field of the Invention

The present invention relates generally to light-emitting diode ("LED") area lamps using a plurality of LEDs operating at relatively high wattages in commercial applications including warehouse, high bay and parking lot applications and more particularly, to housings incorporating features for cooling such lamps.

Background of the Invention

Solid state lamps or lights utilizing arrays of LEDs are now gaining favor for use in a variety of applications including general indoor and outdoor area lighting of commercial warehouse, high bay and parking lot facilities, among a growing list of commercial and residential applications. Lighting systems utilizing LED arrays offer a longer lasting, more efficient alternative to conventional area lights such as incandescent, fluorescent and halogen lights.

LED based lights have certain drawbacks, however. In particular, the high level of luminescence required in an area lamp cannot be achieved by the use of a single LED. In order to achieve luminescence comparable to prior art incandescent, fluorescent and halogen lamps, numerous LEDs are required. Therefore, LEDs have been fabricated in arrays or modules where each module may comprise dozens of individual LEDs. Multiple modules are then packaged within a single lamp housing.

LED lamps comprising multiple modules composed of a plurality of LEDs tend to generate a substantial amount of heat. LEDs are well-known to be sensitive to heat. Excessive heat typically causes the structures forming an LED module to fail or to deteriorate and therefore negatively affect the brightness and service life of the LEDs. LEDs are prone to heat related failures because the circuit boards to which they are mounted are generally poor conductors of heat. LED lamps used in area lighting applications frequently operate within the range of 100 to 300 watts. Operation at such wattage levels is sufficient to degrade the individual LEDs which make up the modules contained in the lamp unless adequate cooling is provided.

The art of LED lamp design is relatively new. While a number of LED lamps featuring a variety of cooling mechanisms have previously been developed, at the present time, no particular design has proven to be superior to other types and the industry has yet to settle on a standardized design. Thus, there remains room for improvement in the art.

Increasing the ability of an LED lamp to dissipate heat allows for the use of higher operational wattages and/or more arrays of LEDs per lamp housing, and thus brighter LED lamps. Accordingly, there is a need in the art for LED lamp housings which include a cooling system to dissipate the heat generated by LEDs operating at high wattages.

SUMMARY OF THE INVENTION

The present invention improves upon the prior art by presenting an LED lamp with an active chamber cooling system. The lamp features a three-part housing comprising a base, a cover and a mid-plate or housing divider. The mid-plate mounts the cooling fans and also serves to divide the case into two cooling chambers, i.e. first and second chambers. The first chamber, referred to as the cold chamber, contains an LED driver and one or more cooling fans mounted to the fan mounting portion of the mid-plate, while the second chamber, referred to as the hot chamber, contains one or more LED modules secured to a heat sink. The mid-plate is configured such that air flow between the first and second chambers only occurs through the openings for the one or more cooling fans. In operation, the fans draw ambient cooling air inside the first or cold chamber via air intake openings or vents in the base and cover of the housing. The ambient cooling air is then drawn from the cold chamber through the fan openings and blown into the second or hot chamber and is forced through a plurality of covered or partially covered heat sink fins or heat transfer channels and exhausted from air exhaust openings or vents in the base of the housing located in the second or hot chamber.

The present invention LED lamp features cooling fans mounted at an angle of about 10 degrees from horizontal to direct the airflow into the second or hot chamber in a downward and forward direction in regards to the heat sink. The mounting angle of the fans is critical to assist the thermal wicking function of the heat sink fins. Experimentation has shown that fan mounting angles in the range of about 8 to 12 degrees are effective with 10 degrees being preferred. Efficiency is reduced at angles of greater than about 12 degrees because the airflow passes too rapidly through the fins of the heat sink reducing the desired thermal draw through the heat sink. Efficiency is also reduced at an angle lower than about 8 degrees because the airflow is partially blocked by the heat sink resulting in less airflow through the fins and reducing the thermal wicking function of the heat sink fins. Fan mounting angles in the effective range of about 8 to about 12 degrees also create a small common air pressure area between the fans and the heat sink fins providing for approximately equal air pressure through all of the heat sink fins. The combination of these factors allows for a minimum airflow requirement reducing fan noise and power consumption.

The LED lamp of the present invention also configures the mid-plate such that, in addition to separating the housing into two compartments, a portion of the mid-plate, referred to as the heat sink interface plate, lays flat across top edges or surfaces of the heat sink fins creating individual channels or thermal transfer chambers between the fins. This feature is critical for the efficient and effective thermal dynamics of the heat sink promoting the greatest thermal wicking effect and prevents the heat sink from reaching saturation.

The above and other features of the invention will become more apparent from the following detailed description.

DETAILED DESCRIPTION OF THE PREFERRED EMBODIMENTS

Figure 1:
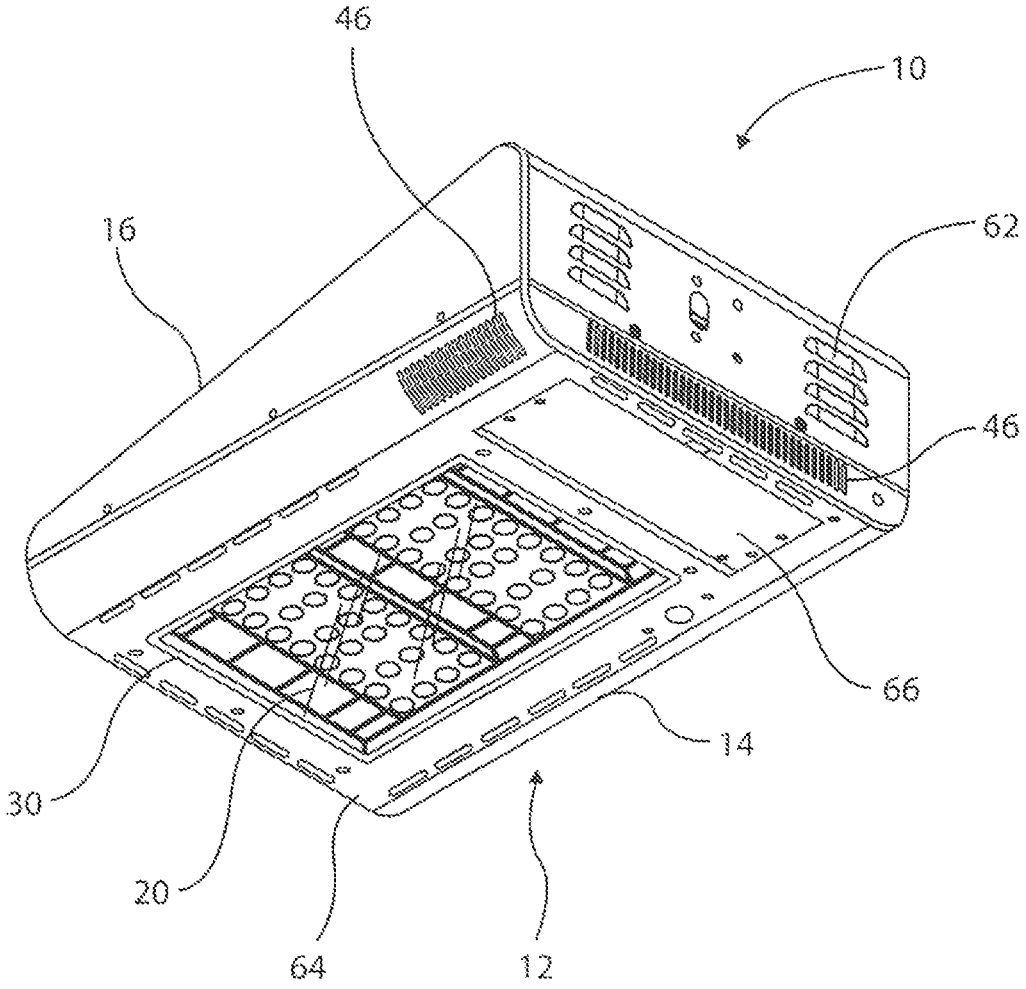
FIG. 1 is a rear perspective view, looking upward, of an LED lamp in accordance with an exemplary embodiment of the present invention.
Figure 2:
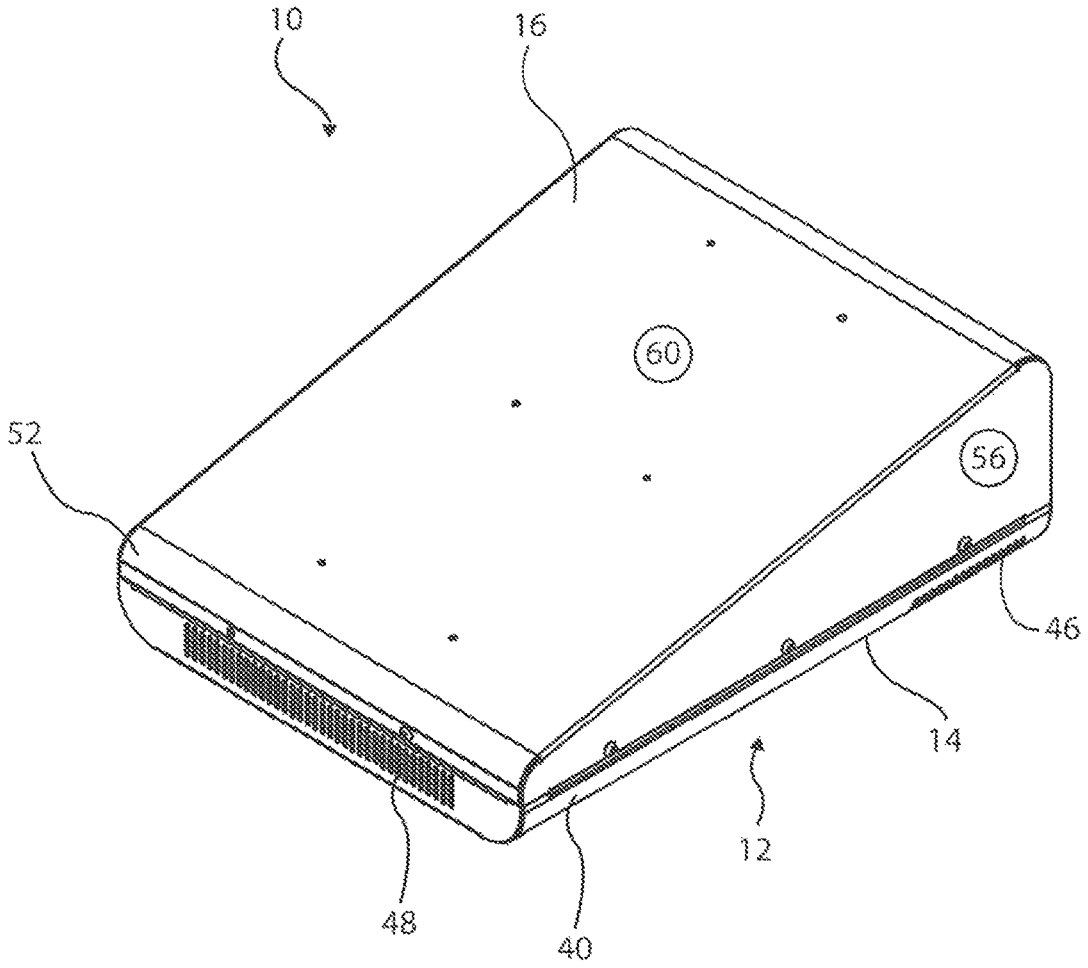
FIG. 2 is a front perspective view, looking downward, of the LED lamp of FIG. 1.
Figure 3:
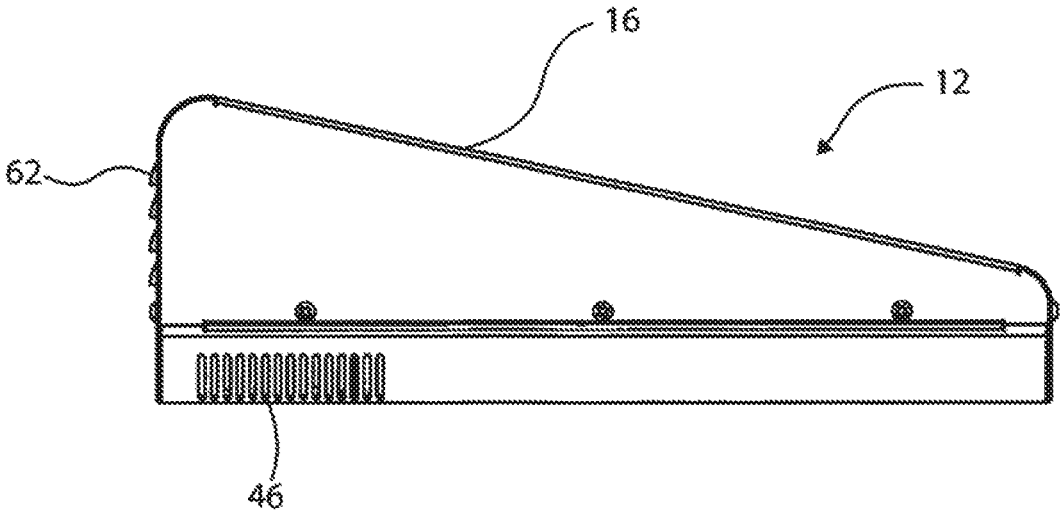
FIG. 3 is a right side view of the LED lamp of FIG. 1.
Figure 4:
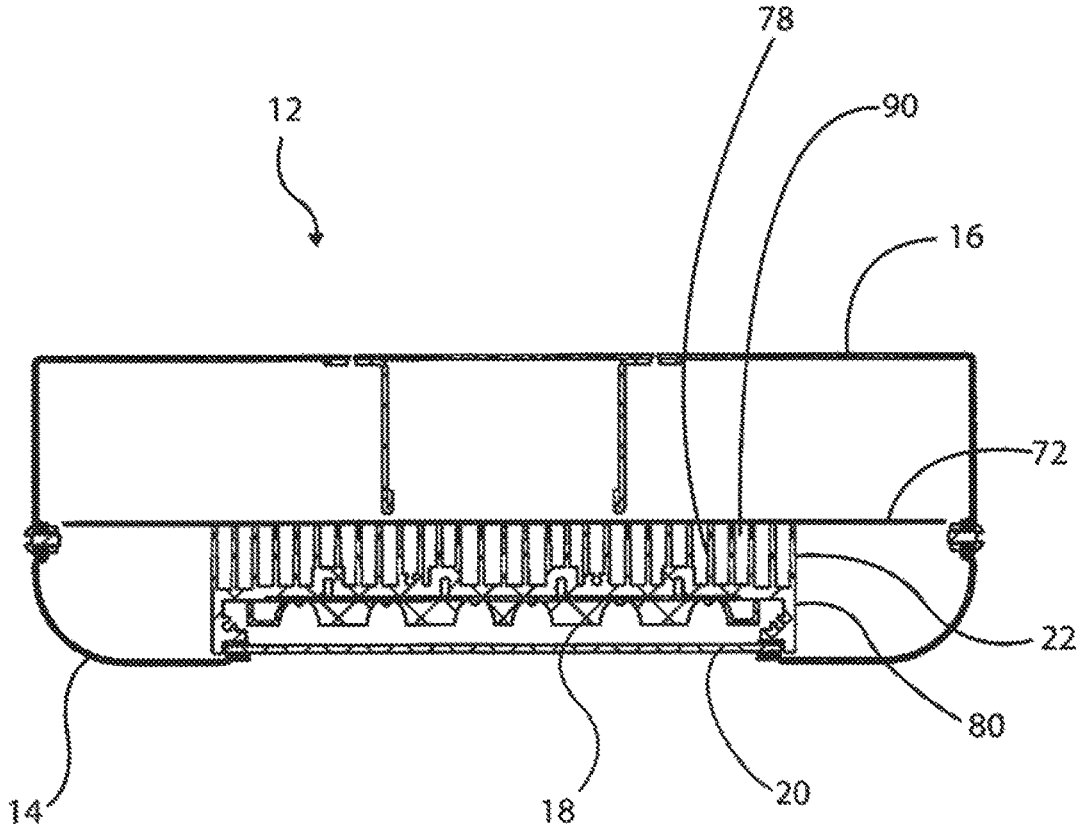
FIG. 4 is a sectional view, taken along the line B-B of FIG. 3, of the LED lamp of the present invention.
Figure 5:
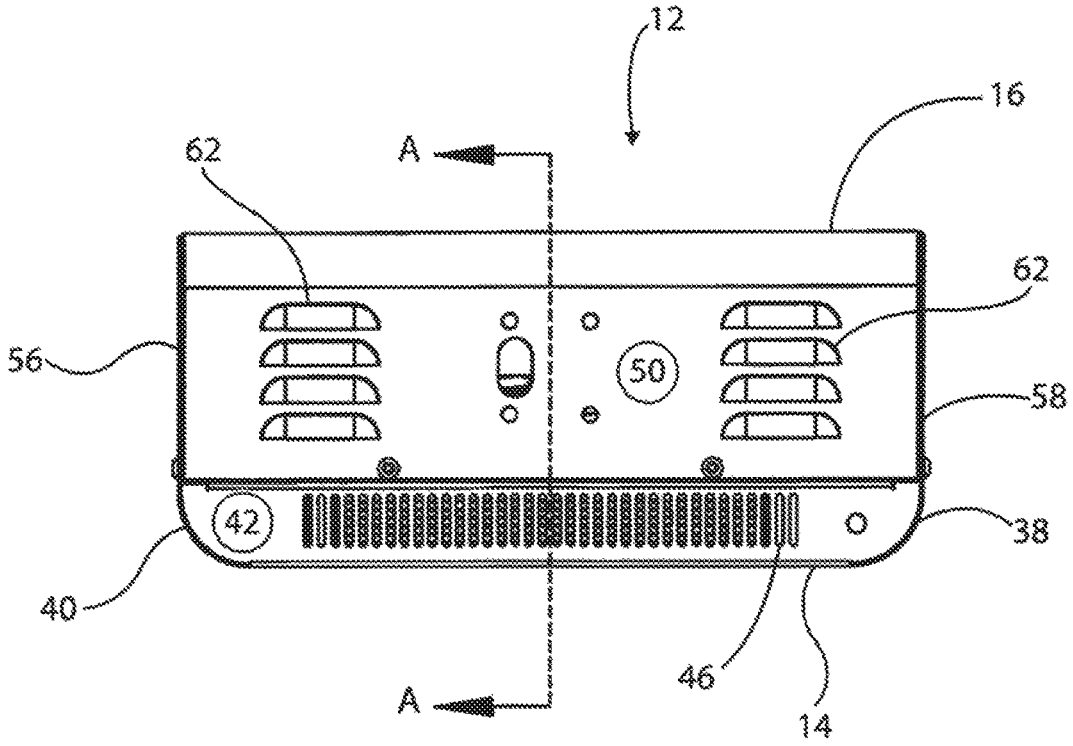
FIG. 5 is a rear end view of the LED lamp of FIG. 1.
Figure 6:
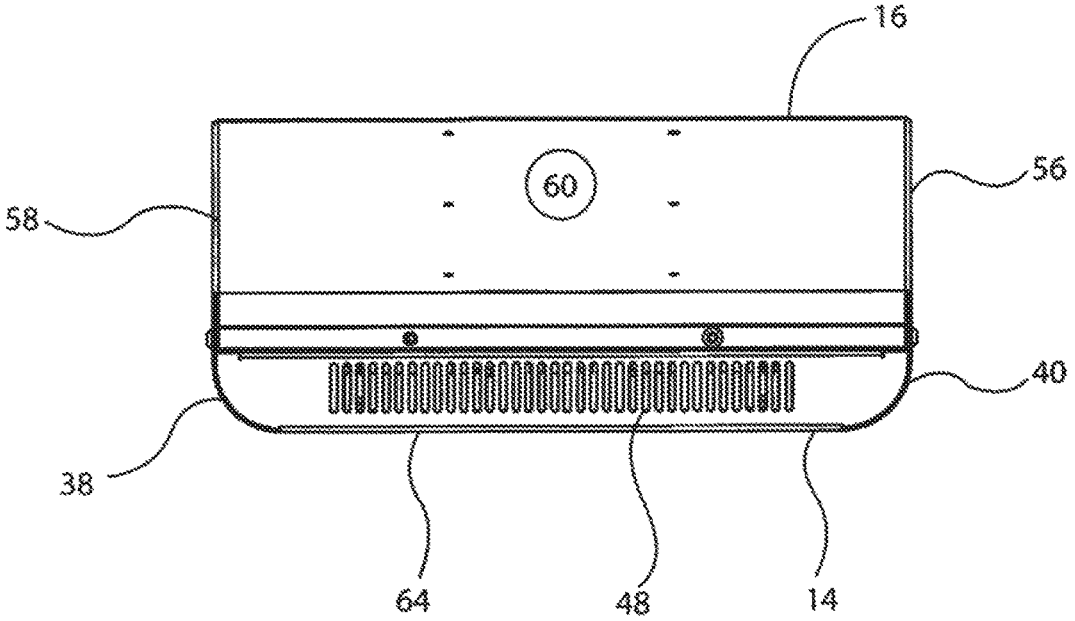
FIG. 6 is a front end view of the LED lamp of FIG. 1.

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

With reference to FIGS. 1-16, and particular reference to FIGS. 1 and 7-9, an LED lamp 10 in accordance with the present invention is presented. The LED lamp 10 comprises generally a housing 12 where the housing includes a base 14, a case cover 16 and a mid-plate 24. Enclosed within the housing 12 are a plurality of LED modules 18 (see FIG. 8), a lens plate 20, a heat sink 22, a plurality of cooling fans 26, and an LED driver 28 (see FIG. 9).

Figure 7:
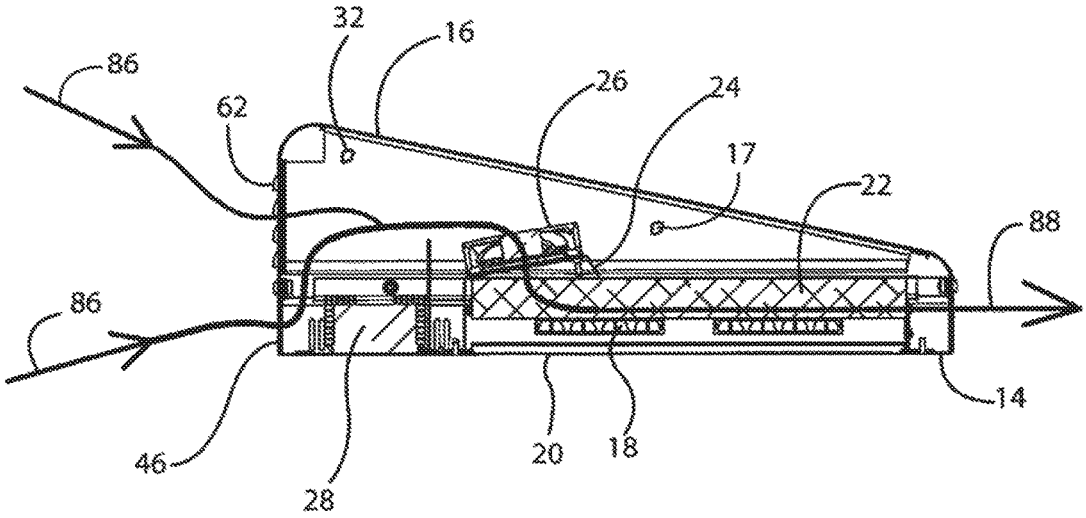
FIG. 7 is a sectional view, taken along the line A-A of FIG. 5, of the LED lamp of the present invention.
Figure 8:
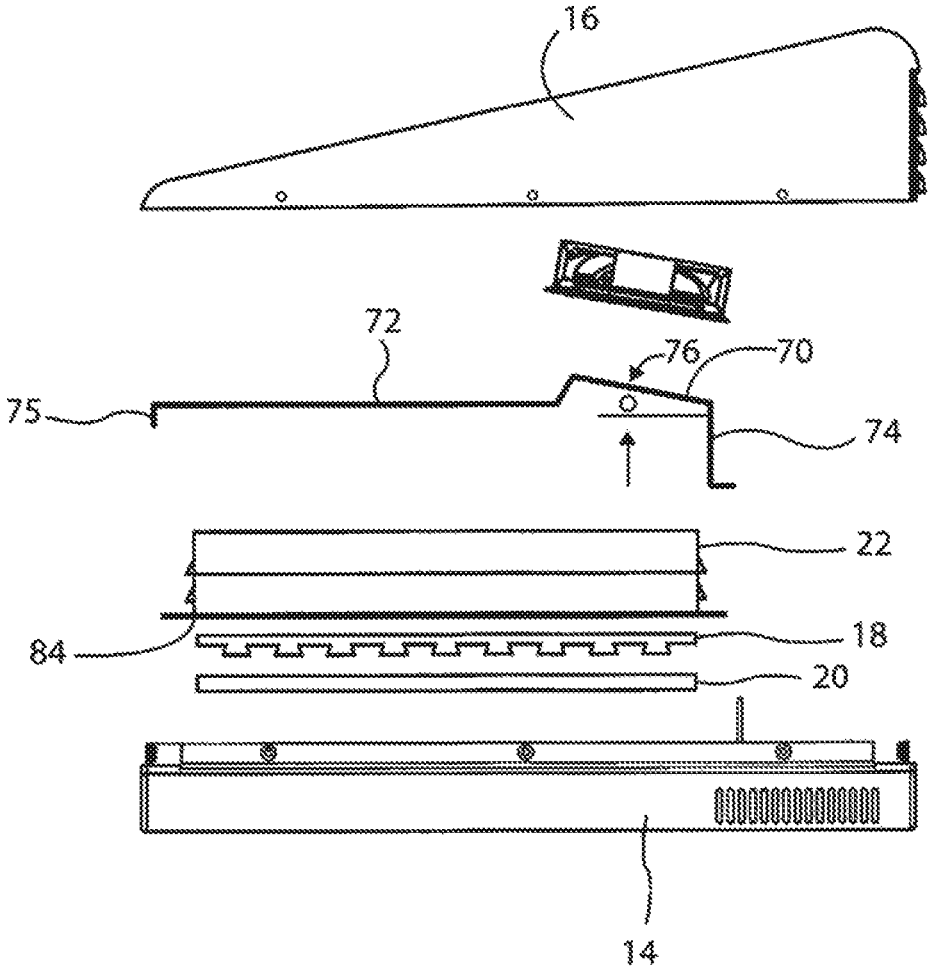
FIG. 8 is an exploded view of the LED lamp of FIG. 1.
Figure 9:
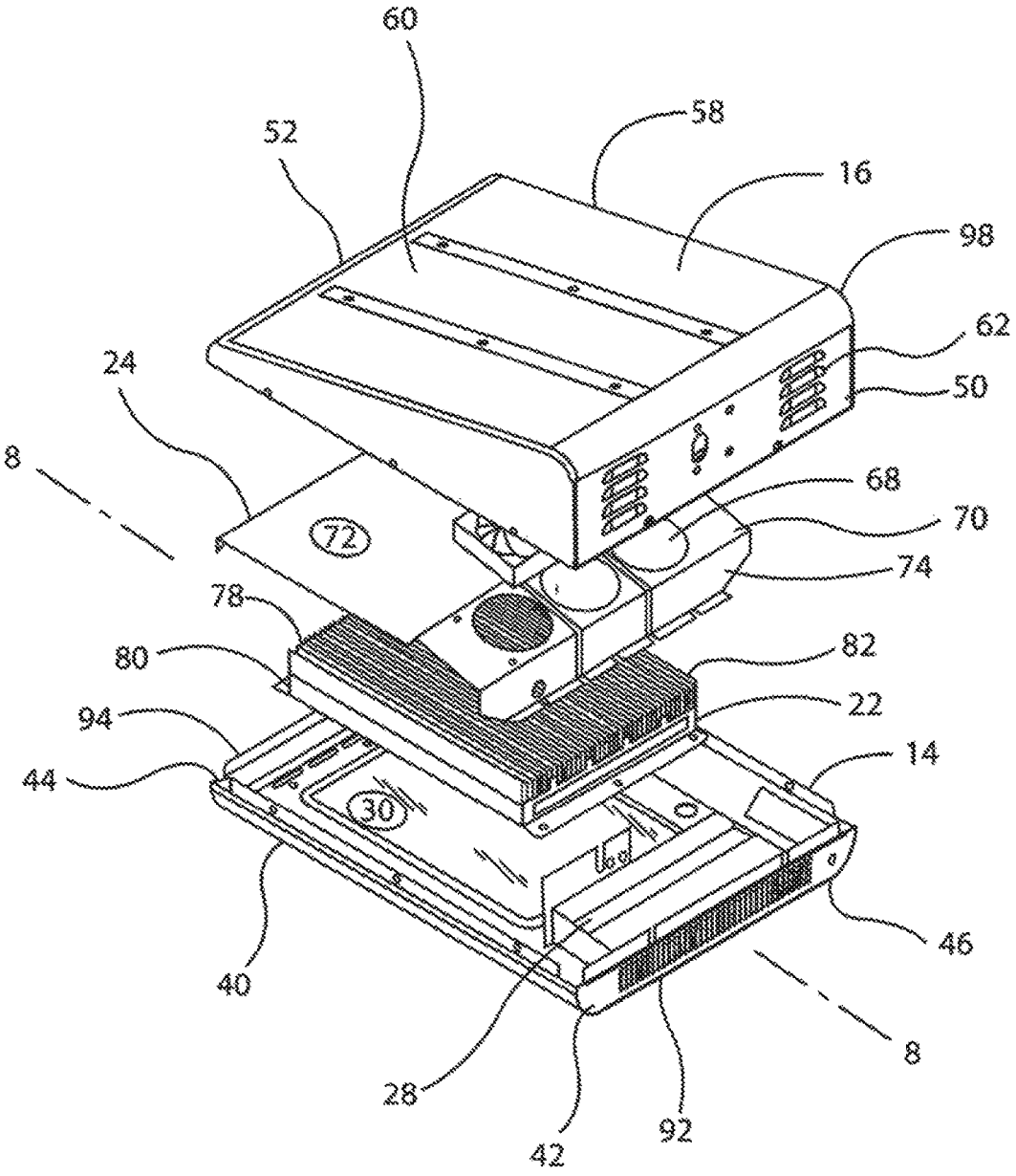
FIG. 9 is an exploded rear perspective view, looking downward, of the LED lamp of FIG. 1
Figure 10:
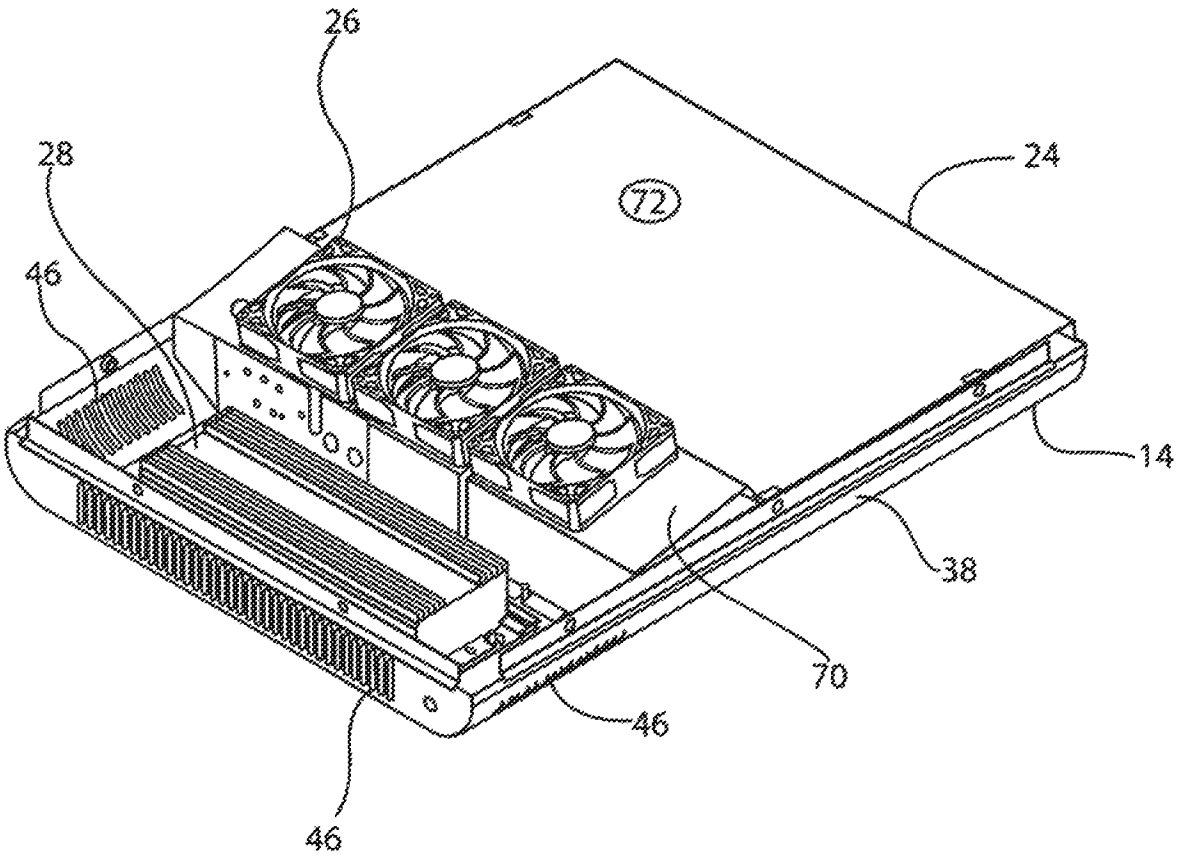
FIG. 10 is a rear perspective view, looking downward, of the LED lamp of FIG. 1, shown with the cover removed.
Figure 11:
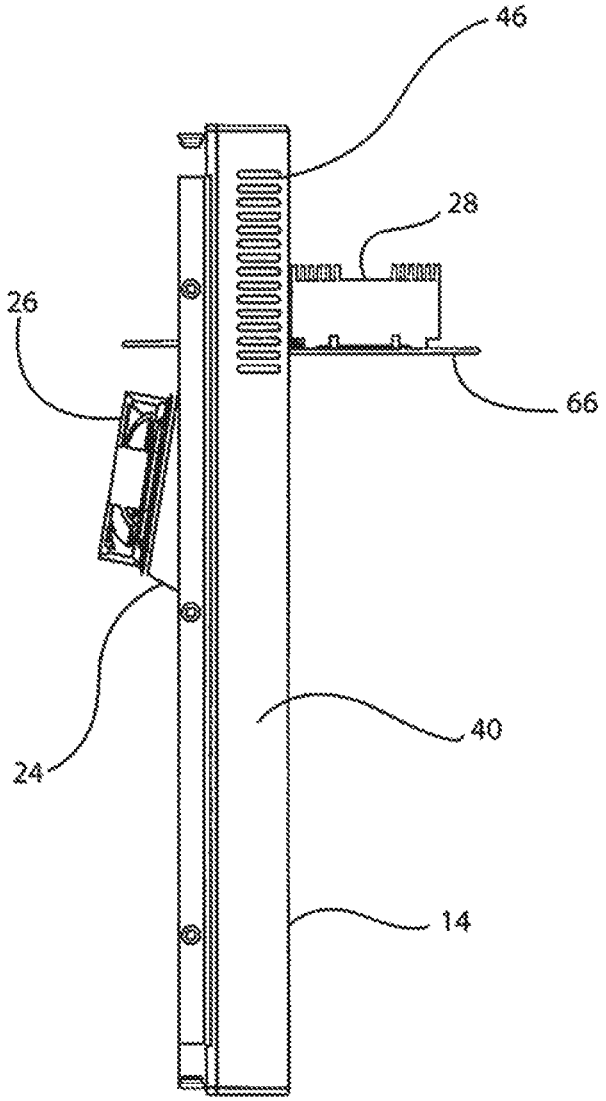
FIG. 11 is a left side view of the LED lamp of FIG. 1, shown with the cover removed and a hinged door in the base of the lamp in the open position.
Figure 12:
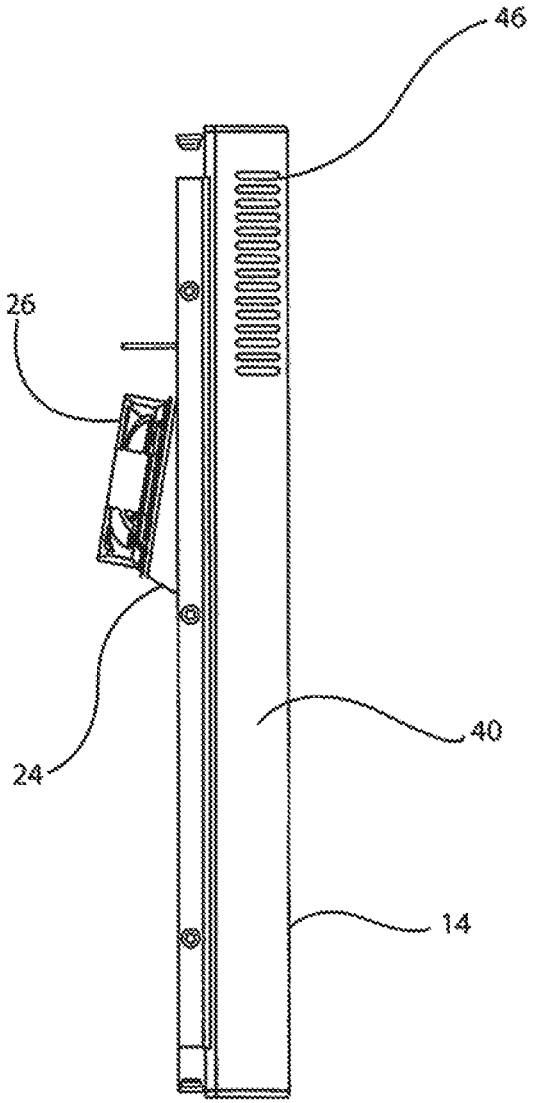
FIG. 12 is a left side view of the LED lamp of FIG. 1, shown with the cover removed.
Figure 13:
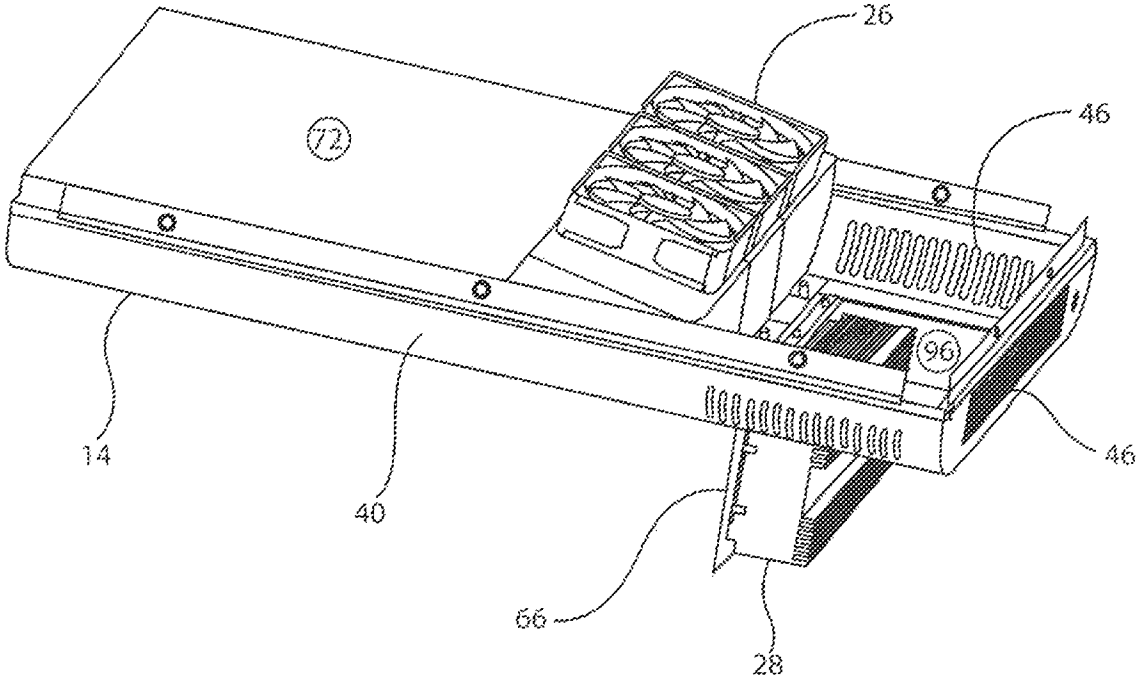
FIG. 13 is a left, rear perspective view of the LED lamp of FIG. 1, shown with the cover removed and a hinged door in the base in an open position.
Figure 14:
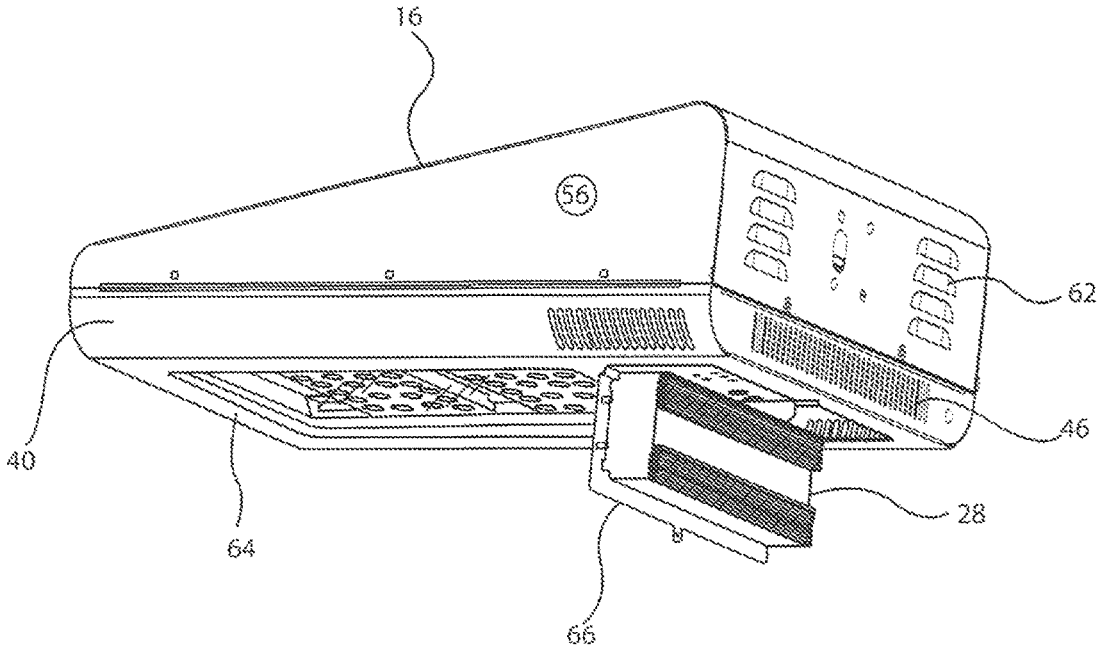
FIG. 14 is a left, rear perspective view of the LED lamp of FIG. 1, shown with a hinged door in the base in an open position.
Figure 15:
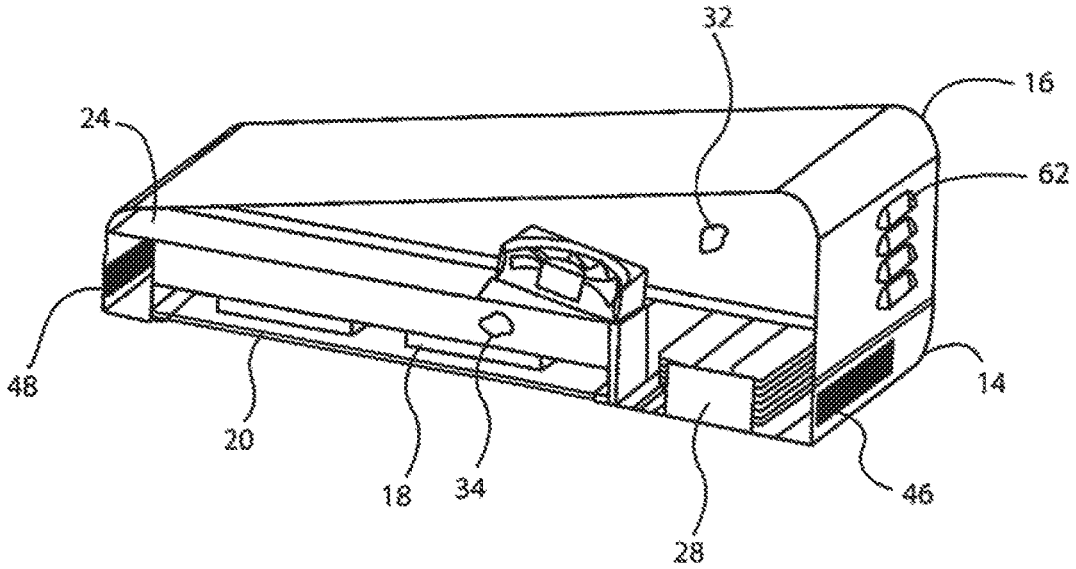
FIG. 15 is a left, side sectional perspective view, taken along the line A-A of FIG. 5, of the LED lamp of the present invention.
Figure 16:
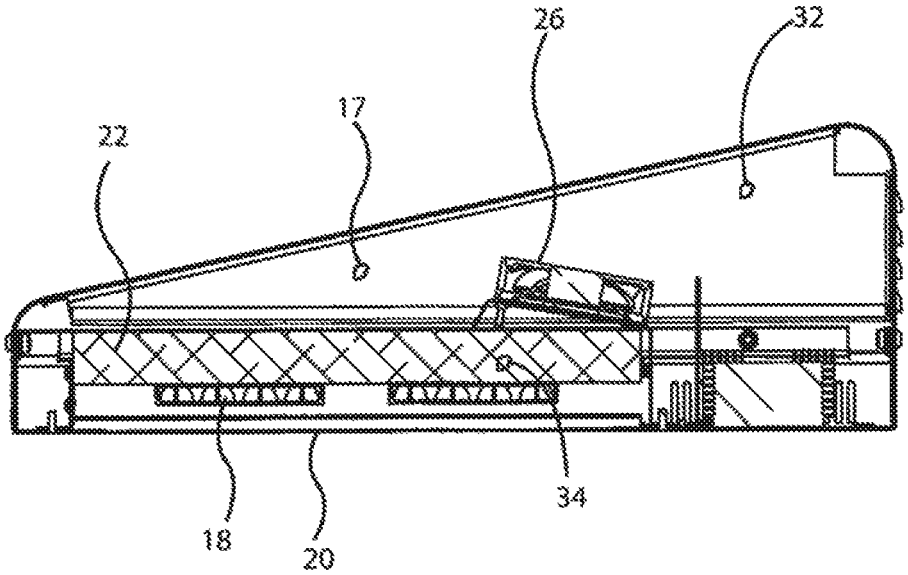
FIG. 16 is a left, side sectional view, taken along the line A-A of FIG. 5, of the LED lamp of the present invention.

In the exemplary embodiment, the housing 12 is formed from sheet metal and comprises the base 14, case cover 16 and the mid-plate 24 (best shown in FIGS. 8 and 9). With reference to FIGS. 7 and 15-16, the housing 12 is shown in the assembled condition. When the case cover 16 is secured to the base 14, an interior space or cavity 17 is formed. In the exemplary embodiment, the mid-plate 24 is secured to the base and when the case cover 16 is installed, the mid-plate 24 splits the interior space or cavity 17 of the housing into two separate compartments, namely the first or cold compartment 32 and the second or hot compartment 34. The first or cold compartment 32 houses the LED driver 28 and one or more cooling fans 26. The second or hot compartment 34 houses the plurality of LED modules 18, the heat sink 22 and the lens-plate 20.

With reference to FIG. 9, in the exemplary embodiment the base 14 of the housing 12 has a longitudinal axis 8 (shown in FIG. 9) and generally includes an aft portion 92 and a forward portion 94 with a base panel 64 therebetween. More specifically, the base 14 is generally rectangular in configuration having right and left longitudinal side panels 38 and 40 which are generally parallel to the longitudinal axis 8 and aft and forward transverse panels 42 and 44 which are generally perpendicular to the longitudinal axis 8, as well as the base panel 64. The base panel 64 includes a first opening 30 from which light from the plurality of LED modules 18 is projected and a second opening 96 (see FIG. 13) which is closed out by a swing open, hinged door panel 66 (see FIGS. 1, 11 and 13-15). In the exemplary embodiment, the LED driver 28 is mounted to the hinged door panel 66 and is enclosed within the first or cold compartment 32 when the hinged door panel 66 is closed.

With continued reference to FIG. 9, formed into the aft transverse panel 42 and aft ends of the longitudinal side panels 38 and 40 are a plurality of ambient air intake openings or slots 46, which are in fluid communication with the first or cold chamber 32 (see FIGS. 7 and 15) of the housing 12. Formed into the forward transverse panel 44 of the housing 12 are a plurality of exhaust air openings or slots 48, which are in fluid communication with the second or hot chamber 34 of the housing 12.

Referring now to FIGS. 1, 11 and 13-15, the base 14 of the housing 12 also includes the hinged door 66 to which the LED driver 28 is mounted. The hinged door 66 has a closed position (see FIGS. 1 and 15) and an open position, (see FIGS. 11 and 13-14). As referenced above, when in the closed position, the LED driver 28 is enclosed within the first or cold chamber 32. The hinged door 66 allows for ready replacement in the field of the LED driver 28, without the need to remove the case cover 16 from the housing 12. The hinged door 66 may optionally be equipped with latch or lock (not shown) to provide secure retention of the LED driver 28 and to prevent unauthorized tampering. Experience has shown that that the LED driver 28 is the component of LED lamps most likely to need replacement during the service life of a lamp.

Referring again to FIG. 9, the case cover 16 generally comprises an aft end portion 98 and a forward end portion 100 with a top panel 60, therebetween. More specifically, in the exemplary embodiment the case cover 16 is of generally wedge shaped configuration and comprises the aft transverse panel 50 and the forward transverse panel 52, which are generally perpendicular to the longitudinal axis 8 of the base 14, and the right side longitudinal panel 56 and the left side longitudinal panel 58, which are generally parallel to the longitudinal axis 8. The cases cover 16 further includes the top panel 60. Formed into the aft transverse panel 50 are a plurality of ambient air intake openings or slots 62, which are in fluid communication with the first or cold chamber 32 (see FIGS. 7 and 15).

With reference to FIGS. 7-9 and 15, the mid-plate 24 functions as a housing or case divider dividing the interior of the housing 12 into the first or cold compartment 32 and the second or hot compartment 34. The mid-plate 24 comprises a fan interface panel 70, a heat sink interface panel 72, an aft standoff panel 74 and a forward lip panel 75. The aft standoff panel 74 vertically spaces the mid-plate 24 from base panel 64, while the forward lip panel 75 functions to stiffen the fan interface panel 70.

The fan interface panel 70 includes a plurality of generally circular fan openings 68. One of the plurality of cooling fans 26 is mounted in each of the fan openings 68 in the fan interface panel 70 of the fan mid-plate 24. With the mid-plate 24 installed in the housing 12, air may flow from the first or cold chamber 32 to the second or hot chamber 34 only via the fan openings 68 in the fan interface panel 70, i.e. air must pass through the fans 26 to move from the first or cold chamber 32 to the second or hot chamber 34.

In the exemplary embodiment, three cooling fans are depicted. The number and size of each of the plurality of cooling fans 26 used in a particular application may be increased or decreased depending upon the number of LED modules 18 used in the lamp and the wattage at which the LEDs are driven. In some applications, only a single cooling fan may be needed. The plurality of cooling fans 26 are electric cooling fans similar in configuration to cooling fans for personal computer cases and may attach to the fan interface panel 70 via mechanical fasteners, such as screws.

The fan interface panel 70 is formed at a fan mounting angle 76 (see FIG. 8) where the fan mounting angle 76 is defined as the upward inclination of the fan interface panel 70 with respect to the heat sink interface panel 72. Experimentation has shown that a fan mounting angle 76 within the range of about 8 to 12 degrees, with a nominal angle of 10 degrees being preferred, to provide adequate airflow between the first or cold compartment 32 and the second or hot compartment 34 of the housing 12. In alternative embodiments, it may be desirable to mount the plurality of cooling fans 26 at a fan mounting angle of greater than 12 degrees, for example at 90 degrees, i.e. such that air flow from the cooling fans is directed parallel to the thermal transfer channels 90.

With continued reference to FIGS. 8-9, the heat sink 22 of the present invention is generally rectangular in configuration and comprises a heat sink base or plate 80 having a bottom LED mounting surface 84 which is generally flat and a plurality of fins 78 which extend upwardly from, and are formed integrally with, the heat sink base or plate 80. The heat sink 22 is installed in the base 14 and arranged such that the fins 78 are parallel to the longitudinal axis 8 of the base 14. The heat sink 22 may be made from a number of thermally conductive materials with copper and aluminum generally being preferred.

The heat sink interface panel 72 of the mid-plate 24 is generally flat and rests on top of and in contact with top edge surfaces 82 of the plurality of fins 78 of the heat sink 22. The heat sink interface panel 72 is configured to cover approximately ½ to ¾ of the longitudinal length, (with ⅔ being preferred), of the top edge surfaces 82 of the heat sink fins 78. With the heat sink interface panel 72 disposed on the top edge surfaces 82 (see FIG. 9) of the heat sink fins 78, channels 90, also referred to as thermal transfer channels (best shown in FIG. 4), are created by the gaps between the heat sink fins 78 which are closed off along their lower length by the base or plate portion 80 of the heat sink and are closed off along their upper length by the heat sink interface panel 72. The thermal transfer channels 90 are critical for the efficient and effective thermal dynamics of the heat sink 22. The thermal transfer channels promote the greatest thermal wicking effect and prevent the heat sink from reaching saturation.

In the exemplary embodiment, the base 14, case cover 16 and mid-plate 24 of the housing 12 are fabricated from formed sheet metal. Sheet metal enclosures are relatively easy to fabricate and assemble and thus are cost effective. The present invention is not limited to enclosures fabricated from sheet metal, however. Other materials and methods of manufacture are also suitable. For example, the base 14, case cover 16 and mid-plate 24 could also be made from a variety of injection molded plastic materials.

LED modules 18, consisting of a plurality of LEDs in electrical circuit mounted on a printed circuit board, suitable for use with the present invention are commercially available from a number of sources including Lumileds. Lumileds Part No. L1T2-507 Luxeon TX which comprises arrays of 28 LEDs which operate at 56 Watts are representative of such suitable modules. Likewise, LED drivers 28, which comprise the electronics necessary to drive the LED modules 18 are commercially available from a number of sources. Drivers from Inventronics, Co., part No. EUC-200S070DT, are representative of such suitable modules. The lamp of the present invention should not be construed as being limited to LED lighting modules. The field of semiconductor based light sources is rapidly developing and it is likely that new technologies compatible with the lamp design herein presented will be substitutable for conventional LED's in the future.

The lens plate 20 of the LED lamp 10 will typically be made from a transparent material with the ability to withstand the heat generated by the LED modules 18. For most applications, scratch resistant, tempered glass will be the material of choice. There are however, a number of transparent polymer materials on the market and these materials may prove suitable some applications. The lens plate 20 primarily serves to protect the LED modules from the elements, i.e. from water and dust intrusion. The lens plate may optionally also serve to focus or direct the light produced by the LED modules.

Assembly of the LED Lamp of the Present Invention

Prior to physical assembly of the LED lamp 10, the LED modules 18 will typically be bonded to the LED mounting surface 84 of the heat sink 22 with a thermally conductive adhesive. With reference to FIGS. 8-9, beginning with the base 14, in the exemplary embodiment, the lens-plate 20 will typically be installed in the base via a gasket and an adhesive sealant and/or mechanical fasteners. The heat sink 22 with the LED modules 18 mounted thereon are then attached as an assembly to the base 14 via mechanical fasteners or adhesives, spot welding or other suitable means known in the art. The mid-plate 24 is then attached to the base via mechanical fasteners, spot welding, structural adhesives or other suitable fastening means.

It is particularly important that the heat sink interface panel 70 of the mid-plate 24 be in contact with the top edge surfaces 84 of the heat sink fins 78. Thermal gel or adhesive may optionally be used to improve conductivity between the top edge surfaces 84 of the heat sink fins 78 and the heat sink interface panel 72. Next, the plurality of fans 26 are attached to the fan interface panel 70 of the mid-plate 24, again, typically, via mechanical fasteners. Subsequently, the LED driver 28 is installed on the hinged door 66 of the base 14. Thereafter, electrical connections between the LED modules 18, LED driver 28 and fans are made and the case cover 16 installed. The case cover 16 is secured to the base, typically via mechanical fasteners. It should be noted that although a plurality of fans 26 is referred to throughout this description, in alternative embodiments, depending upon the specific lighting requirements of a particular installation, the lamp of the present invention 10 could be made using only a single cooling fan 26.

Operation of the Present Invention LED Lamp Housing

Referring now to FIG. 7, in the present invention LED lamp 10, heat sink cooling is accomplished as follows. The plurality of cooling fans 26 draw or pull ambient air from outside the housing 12 inside the first or cold compartment 32 via the air intake openings or slots 46 in the base 14 and air intake openings or slots 62 in the case cover 16. (See arrows 86 of FIG. 7 which are representative of the airflow.) The cooling air is then blown into the second or hot compartment 34 and through the heat sink fins 78 and thermal transfer channels 90, which comprise the gaps between the heat sink fins 78 which are bounded at their upper ends by the heat sink interface panel 72 and at their lower ends by the heat sink base or plate portion 80. The air then exits the housing 12 via the exhaust openings or slots 48 in the base 14. (See arrow 88 of FIG. 7 which is representative of the airflow.)

The plurality of cooling fans 26, attached to the fan interface panel 70, are held at the fan mounting angle 76. (See FIG. 8.) A fan mounting angle 76 of about 10 degrees is required to direct the air flow in a downward and forward direction in regards to the heat sink 22. The fan mounting angle 76 is critical to assist the thermal wicking function of the heat sink fins 78. Experimentation has shown that fan mounting angles in the range of about 8 to 12 degrees are acceptable with 10 degrees being preferred.

At fan mounting angles 76 of greater than about 12 degrees, the airflow passes too rapidly through the fins 78 reducing the desired thermal draw through the heat sink base or plate 80 into the fins 78 and at an angle lower than about 8 degrees, the airflow is substantially blocked by the heat sink base or plate 80 resulting in less airflow through the fins 78 and reducing the thermal wicking function of the fins. Fan mounting angles 76 in the acceptable range of about 8 to about 12 degrees also create a small common air pressure area between the plurality of cooling fans 26 and the heat sink fins 78 providing for approximately equal air pressure through all of the heat sink fins. The combination of these factors allows for a minimum airflow requirement reducing fan noise and power consumption.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. An LED lamp employing active chamber cooling, comprising:

a base having a longitudinal axis, a case cover, a mid-panel, a lens plate, a plurality of LED modules, an LED driver, a heatsink, and a plurality of cooling fans;

wherein, the base is of generally rectangular configuration having a base panel, forward and aft panels generally perpendicular to the longitudinal axis, opposing right and left side panels generally parallel to the longitudinal axis, the base panel also including a first opening, the first opening configured to secure the lens plate, and a second opening, the second opening including a hinged, swing open door; the base also including air inlet openings in the aft panel and air discharge openings in the forward panel;

wherein the heatsink comprises a plate portion, the plate portion having a generally flat bottom surface and a plurality of fins which extend upwardly therefrom, the plurality of fins being oriented parallel to the longitudinal axis of the base, each fin having a thickness and an upper surface;

wherein, the plurality of LED modules are secured to the generally flat bottom surface of the heat sink;

wherein, the heat sink is secured to the base such that there is an air gap between the plurality of LED modules and the lens plate;

wherein, the mid-panel includes a horizontal heat sink interface panel and a fan mounting panel, the fan mounting panel being angled upwardly with respect to the heat sink interface panel in order to blow air upwardly toward the heat sink interface panel, the fan mounting panel including a plurality of openings for the receipt of one each of the plurality of cooling fans;

wherein, the case cover includes an aft panel, the aft panel including air intake openings, the cover being securable to the base to form an interior space;

wherein, the mid-plate is secured within the interior space and divides the interior space into a first chamber between the mid-plate and the cover and a second chamber between the mid-plate and base;

wherein, the LED driver is secured to the swing open door such that the LED driver is enclosed within the first chamber when the door is closed;

wherein, when the plurality of cooling fans are in operation, air is drawn through the air intake openings into the first chamber, through the cooling fans, and blown into the second chamber across the heat sink and expelled through the air discharge openings.

2. The LED lamp employing active chamber cooling of claim 1, wherein the heat sink interface panel is in contact with the upper surface of each of the plurality of fins to form a plurality of thermal transfer channels between the plurality of fins, wherein at least a portion of the air blown through the lower chamber by the plurality of cooling fans flows through the plurality of thermal transfer channels.

3. The LED lamp employing active chamber cooling of claim 1, wherein the heat sink interface panel covers approximately ½ to ¾ of a longitudinal length of the plurality of heat sink fins.

4. The LED lamp employing active chamber cooling of claim 1, wherein the fan mounting plate is angled upwardly from the heat sink interface panel within a range of about 8 to about 12 degrees.

5. The LED lamp employing active chamber cooling of claim 1, wherein air flows from the first chamber to the second chamber solely through the plurality of cooling fans.

6. The LED lamp employing active chamber cooling of claim 1, wherein the fan mounting plate is angled upwardly from the heat sink interface panel at an angle of about 10 degrees.

7. A lamp employing active chamber cooling, comprising:

a base having a longitudinal axis, a case cover, a mid-panel, a plurality of lighting modules, a lighting module driver, a heatsink, and a plurality of cooling fans;

wherein, the base has a longitudinal axis and includes a base panel, aft and forward end portions, and an open upper end;

wherein, the base panel includes a first opening, the aft portion of the base includes air inlet openings and the forward portion of the base includes air discharge openings, and a second opening, the second opening including a hinged, swing open door;

wherein the heatsink comprises a bottom surface having a plurality of fins which extend upwardly therefrom, the plurality of fins being oriented parallel to the longitudinal axis of the base;

wherein, the plurality of lighting modules are secured to the bottom surface of the heat sink;

wherein, the heat sink is secured to the base such that the plurality of lighting modules project light through the first opening;

wherein, the mid-panel includes a heat-sink interface panel and a fan mounting panel, the fan mounting panel being angled upwardly with respect to the heat sink interface panel in order to blow air upwardly toward the heat sink interface panel, the fan mounting panel including a plurality of openings for the receipt of one each of the plurality of cooling fans;

wherein, the case cover includes an aft portion, the aft portion including air intake openings, the cover being securable to the base to form an interior cavity;

wherein, the mid-plate is secured within the interior cavity and divides the interior cavity into a first chamber between the mid-plate and the cover and a second chamber between the mid-plate and base;

wherein, when the cooling fans are in operation, air is drawn through the air intake openings into the first chamber by the plurality of cooling fans and blown into the second chamber across the heat sink and expelled through the air discharge openings.

8. The lamp employing active chamber cooling of claim 7, wherein the base panel includes a second opening, the second opening including a hinged door, wherein the lighting module driver is secured to the hinged door such that the lighting module driver is enclosed within the upper chamber when the hinged door is closed.

9. The lamp employing active chamber cooling of claim 7, wherein the heat sink interface panel is in contact with the plurality of fins of the heat sink to form a plurality of thermal transfer channels between the fins, wherein at least a portion of the air blown through the second chamber by the plurality of cooling fans flows through the plurality of thermal transfer channels.

10. The lamp employing active chamber cooling of claim 9, wherein the heat sink interface panel covers approximately ½ to ¾ of a longitudinal length of the plurality of heat sink fins.

11. The lamp employing active chamber cooling of claim 10, wherein the fan mounting plate is angled upwardly from the heat sink interface panel within a range of about 8 to about 90 degrees.

12. The lamp employing active chamber cooling of claim 10, wherein the fan mounting plate is angled upwardly from the heat sink interface panel at an angle of about 10 degrees.

13. The lamp employing active chamber cooling of claim 7, wherein air flows from the first chamber to the second chamber solely through the plurality of cooling fans.

14. The lamp employing active chamber cooling of claim 7, wherein the plurality of lighting modules are LED modules.

15. A lamp employing active chamber cooling, comprising:

a base having a longitudinal axis, a case cover, a mid-panel, a lighting module, a heatsink, and a cooling fan;

wherein, the base includes a base panel and aft and forward end portions;

wherein, the base panel includes an opening, the aft end portion includes an air inlet opening and the forward end portion includes an air discharge opening, and a second opening, the second opening including a hinged, swing open door;

wherein, the lighting module is secured to the heat sink;

wherein, the heat sink is secured to the base such that the lighting module is disposed over the opening in the base panel;

wherein, the case cover encloses the base forming an enclosed compartment;

wherein, the mid-panel is secured within the compartment and divides the compartment into a first chamber and a second chamber;

where, the mid-panel includes a heat-sink interface panel and a fan mounting panel, the fan mounting panel being angled upwardly with respect to the heat sink interface panel in order to blow air upwardly toward the heat sink interface panel, the fan mounting panel including an opening for the receipt of the cooling fan;

wherein, when the cooling fan is in operation, air is drawn through the air intake opening into the first chamber and blown into the second chamber across the heat sink and expelled through the air discharge opening.

16. The lamp employing active chamber cooling of claim 15, wherein the heatsink comprises a plate portion, the plate portion having a plurality of fins which extend upwardly therefrom, the plurality of fins being oriented parallel to the longitudinal axis of the base and each of the plurality of cooling fins having a top surface.

17. The lamp employing active chamber cooling of claim 15, wherein the heatsink is located in the first chamber.

18. The lamp employing active chamber cooling of claim 17, wherein the heat sink interface panel covers at least a portion of the top surfaces of the plurality of cooling fins to form channels between the fins.

19. The lamp employing active chamber cooling of claim 17, wherein, when the cooling fan is in operation, a portion of the air drawn from the first chamber into the second chamber is blown through the channels between the cooling fins of the heat sink and expelled through the air discharge opening.

20. The lamp employing active chamber cooling of claim 15, wherein the fan mounting plate is angled upwardly from the heat sink interface panel within a range of about 8 to about 12 degrees.

* * * * *